United States Patent [19]

Schmidt et al.

[11] Patent Number: 4,670,136

[45] Date of Patent: Jun. 2, 1987

[54] SCREEN SURFACING WITH EXCHANGEABLE SCREEN ELEMENTS

[75] Inventors: Gerhard Schmidt, Ettlingen; Wolfgang Lehmann, Kuppenheim, both of Fed. Rep. of Germany

[73] Assignee: Isenmann, Drahterzeugnisse GmbH, Karlsruhe, Fed. Rep. of Germany

[21] Appl. No.: 768,926

[22] Filed: Aug. 23, 1985

Related U.S. Application Data

[63] Continuation of Ser. No. 585,141, Mar. 1, 1984.

[30] Foreign Application Priority Data

Mar. 5, 1983 [DE] Fed. Rep. of Germany ..... 3307916

[51] Int. Cl.[4] ..... B07B 1/46

[52] U.S. Cl. ..... 209/403; 209/399; 209/404; 209/405; 411/339

[58] Field of Search ..... 209/393, 394, 395, 403, 209/405, 408, 399, 404; 403/313, 309, 310, 405; 24/297, 453, 336, 459; 411/338, 339

[56] References Cited

U.S. PATENT DOCUMENTS

| | | | |
|---|---|---|---|
| 3,074,520 | 1/1963 | Grubelich | 24/297 |
| 3,512,328 | 5/1970 | Eriksson | 411/339 |
| 3,726,553 | 4/1973 | Reynolds | 411/339 |
| 3,795,311 | 3/1974 | Martin | 209/403 |
| 4,141,821 | 2/1979 | Wolff | 209/405 |
| 4,383,919 | 5/1983 | Schmidt | 209/399 |
| 4,409,099 | 10/1983 | Wolff | 209/399 |

FOREIGN PATENT DOCUMENTS

| | | | |
|---|---|---|---|
| 105395 | 10/1938 | Australia | 411/339 |
| 1053876 | 3/1953 | Fed. Rep. of Germany | 411/339 |
| 2750365 | 8/1978 | Fed. Rep. of Germany | 209/463 |
| 2273662 | 2/1979 | Fed. Rep. of Germany | 209/395 |
| 2849838 | 9/1979 | Fed. Rep. of Germany | 209/339 |
| 589735 | 3/1959 | Italy | 24/662 |

*Primary Examiner*—S. Leon Bashore
*Assistant Examiner*—Thomas M. Lithgow
*Attorney, Agent, or Firm*—Karl F. Ross; Herbert Dubno

[57] ABSTRACT

The invention relates to a screen surfacing with exchangeable screen elements fastened juxtaposed, which are fastened on a load-bearing substructure. A plastic profile (2) which engages under the edges of at least two mutually adjacent screen elements (14, 15) is fastened on the load-bearing substructure (1) in the region in which two adjacent screen elements (14, 15) adjoin mutually. A second, upper profile (8) is fastened detachably over this plastic profile (2), and a screen element (14, 15) is retained and clamped between the first and second profile on each of two sides.

11 Claims, 8 Drawing Figures

Fig.2
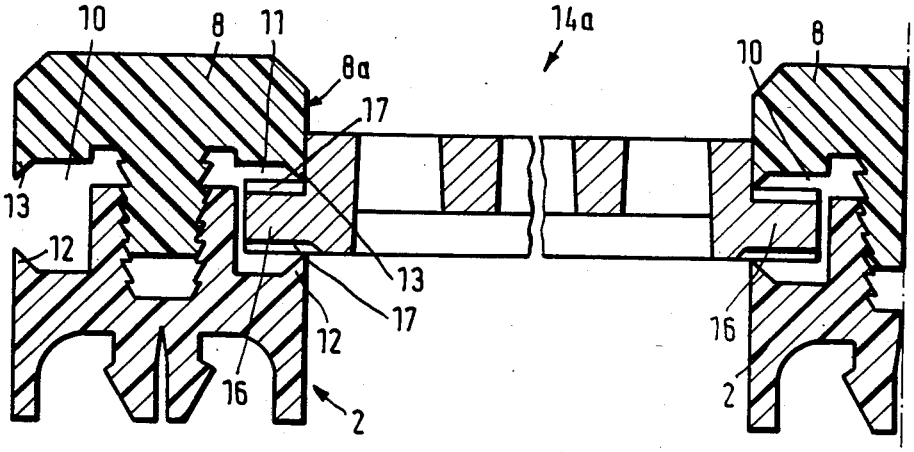
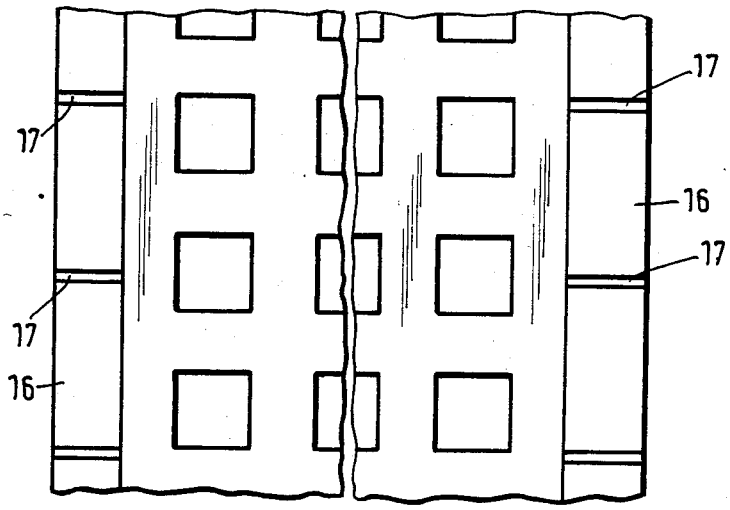
Fig.3

SCREEN SURFACING WITH EXCHANGEABLE SCREEN ELEMENTS

This is a continuation of co-pending application Ser. No. 585,141 filed on 1 Mar. 1984.

FIELD OF THE INVENTION

The invention relates to a screen surfacing with replaceable screen elements, which are fastened to a load-bearing substructure.

BACKGROUND OF THE INVENTION

Exchangeable or replaceable screen elements of plastics, particularly polyurethane, are known screening media and can have grooves on the underside near the longitudinal sides in order to slide the screen elements with their grooves over metal rails, while an upper region of each metal rail engages in the groove. If a part of the screening unit should be equipped permanently or temporarily with metal screen meshes or screen grills instead of plastic screen elements, plastic bars can be connected by screws with the metal rails so that the metal screens are pressed onto the metal rails. It is necessary for this purpose to drill holes for the screws in the metal screen and in the metal rail. Alternatively it is known, for welded grills, to fasten plastic bars to the metal rails and to provide these plastic bars with horizontal bores in order to slide the ends of the welded grills into the latter. Both modes of fastening are time and labor consuming for assembly and require a particular adaptation for each metal screen. Any change in the types of metal screens necessitates a substantial outlay.

OBJECT OF THE INVENTION

The object of the invention is to improve a screen surfacing of the type initially stated, so that metal screens can be assembled and exchanged simply and rapidly together or alternatively with plastic screen elements, the widest variety of metal screens (such as wire mesh and pressure welded grills) can be fastened and changed without adaptation work, and the various screen elements are also securely retained.

SUMMARY OF THE INVENTION

This object is achieved according to the invention, when a plastic profile which engages under the edges of at least two mutually adjacent screen elements is fastened on the load-bearing substructure in the region in which two adjacent screen elements adjoin mutually, a second, upper profile is fastened detachably over this plastic profile, and a screen element is retained and clamped between the first and second profiles on each of two sides.

This mode of fastening permits a simple and rapid assembly of the widest variety of screens, while after one type of screen, for example a wire mesh, has been used, another type of screen, for example a pressure welded grill or plastic screen, can be fastened securely without adaptation work. A plastic element can also be fastened instead of a metal screen element with a minimum labour outlay at any time. Furthermore, this construction provides reliable protection of the metal rails from wear, small overall dimensions and low weight. Moreover, the upper and lower profile form the edge of a screen element, so that when the screen elements are replaced only those surfaces performing the screening, and not the screen element edges, are renewed. This represents a substantial economy of material. The teaching of the invention this involves a separation of retaining elements and effective screening parts of a screen element.

BRIEF DESCRIPTION OF THE DRAWING

Three exemplary embodiments of the invention are illustrated in the drawing and described more fully below. In the drawing:

FIG. 2 is a vertical section through a second exemplary embodiment;

FIG. 3 is a plan of a screen element according to the second exemplary embodiment.

SPECIFIC DESCRIPTION

Figure 1:
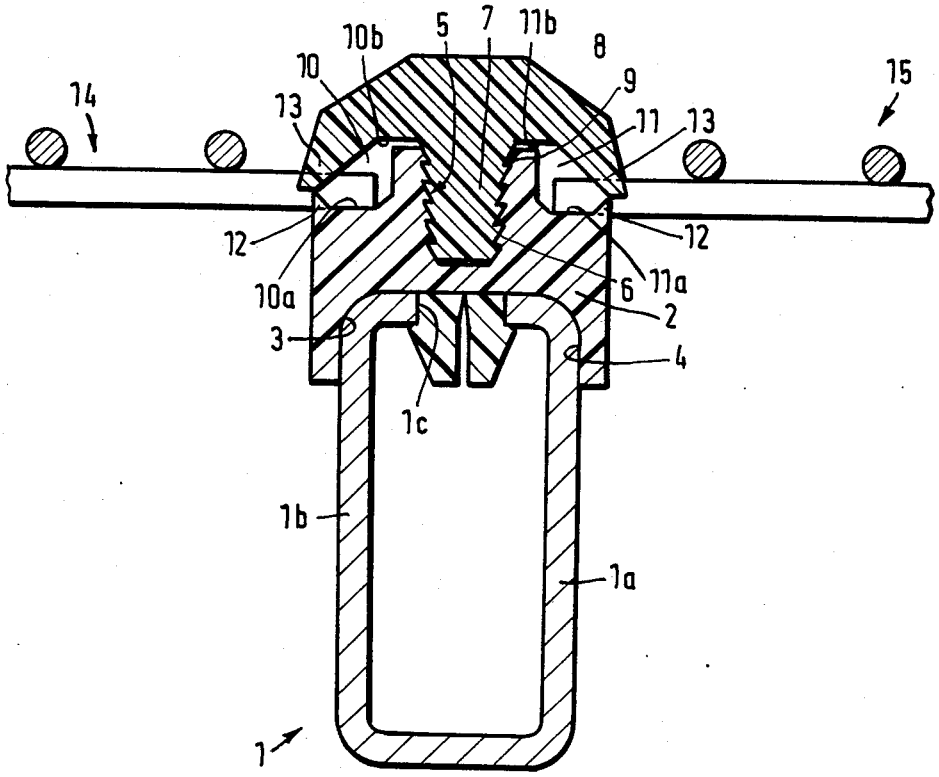
FIG. 1 is a vertical section through a first embodiment.

The two members of an upwardly open U-shaped profile or channel 1 form a first and second metal rail 1*a* and 1*b*, the top ends of the members of which are bent inwards and have a gap 1*c* between them. A first, lower profile 2 of plastic, in particular polyurethane, which is fastened on the profile 1, exhibits on its underside two longitudinal grooves 3, 4 which receive the upper inwardly bent ends of the rails 1*a*, 1*b*.

A longitudinal groove 5, the two parallel lateral walls of which are generally vertical when fastened in a screening machine and exhibit sawtooth-shaped setbacks 6 with the steeper flanks of the teeth facing the groove bottom, is made centrally in the upper side of the profile 2. This grooves 5 is engagingly occupied by a feather-shaped bar 7, which is molded onto the under side of a second upper profile 8 of plastic, particularly polyurethane. The bar 7 has the same width as the groove 5 and has sawtooth-shaped elevations 9 of complementary shape. Because two or more, particularly four to seven teeth, are provided along the total length of strip or also groove on each lateral wall or lateral face of the projection 7 and of the recess 5, a reliable retention of the upper profile 8 is obtained, not only when the bar 7 is fully inserted into the groove 5, but also with only partial insertion, so that different mutual spacings of the profiles 2, 8 can be achieved with reliable fastening. Only when two teeth of the bar 7 are engaged on each side in the groove 5 is it necessary to exert a very great force in the direction of the arrow A in order to detach the profile 8 from the profile 2.

The profiles 2, 8 form a gap 10, 11 between them on each of their two sides, while the lower lateral walls 10*a*, 11*a* of the gaps are formed by the lateral upper side of the lower profile 2, and the upper lateral walls 10*b*, 11*b* by the lateral undersides of the upper profile 8. Elevations (longitudinal ribs, lips) 12, 13 parallel to the profiles 2, 8 and projecting into the gaps (grooves) 10, 11, having a cross-section tapering with the interval from the relevant lateral wall and preferably tooth-shaped, particularly sawtooth-shaped, are molded onto the lateral walls 10*a*, 10*b*, 11*a* 11*b*. The tooth-shaped elevations 12 of the lateral walls 10*a*, 11*a* are aligned by one flank with the lateral walls of the lower profile 2 and are made smaller in cross-section than the elevations 13 on the upper profile 8. The elevations 12, 13 are flexible because of the limited yielding plastic material.

Metal reinforced plastic screen elements or metal screen elements, particularly wire mesh or pressure welded grills 14, 15 occupying the two gaps 10, 11 are gripped by the lateral walls of the gaps 10, 11, particularly by the elevations 12, 13, while these elevations yield limitedly in the region of the screen wires and/or screen profiles and are partially deformed outwards. The projection 7 of the profile 8 can be slid more or less deeply into the profile 2 according to the thickness of the parts of the metal grills. The upper profile 8, particularly in the region of the elevation 13, exhibits a greater width than that of the lower profile 2, so that the profiles 1 and 2, and particularly those regions of the screen elements located in the gaps 10, 11, and also the gaps 10, 11 themselves, are reliably protected from the material which is screened. The exemplary embodiment illustrated in FIGS. 2 and 3 differs from that according to FIG. 1 in that, instead of a metal screen element, a screen element 14*a* of plastic is used, which exhibits a smaller thickness at the edges which are retained and clamped between the profiles 2, 8. These edge strips 16, which are molded on at two mutually opposite sides, particularly the longitudinal sides, may have their upper side placed lower than the effective screening surface of the element, so that a vertical lateral edge 8*a* of the upper profile 8 abuts and seals with the lateral end face of the element 14*a*. the edge strips 16 exhibit, at regular intervals transversely to the longitudinal extension, elevations or ribs 17 which may also be arranged additionally on the under sides of the edge strips as elevations or ribs 17 and are gripped by the elevations 12 and 13 and thereby give the screen element additional retention in the direction of the edge strip.

Figure 4:
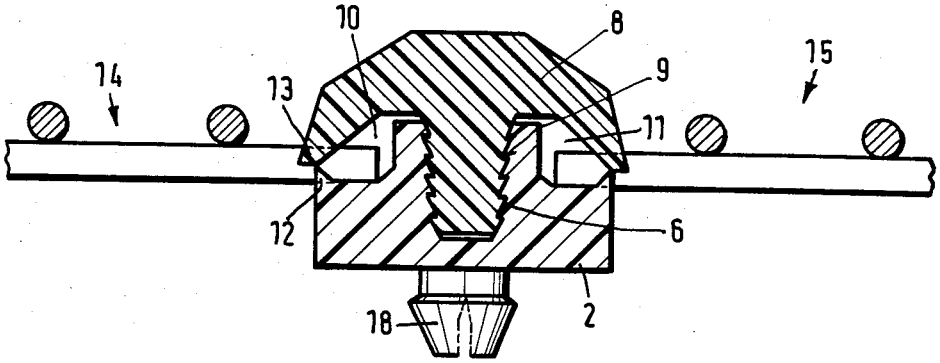
FIG. 4 is a vertical section through a third exemplary embodiment.
Figure 5:
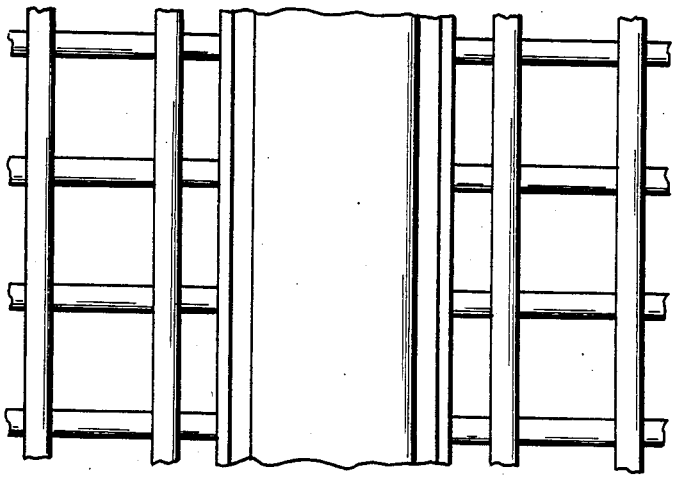
FIGS. 5 and 6 are top and right side views respectively of FIG. 1 and FIGS. 7 and 8 are top and right side views respectively of FIG. 4.
Figure 6:
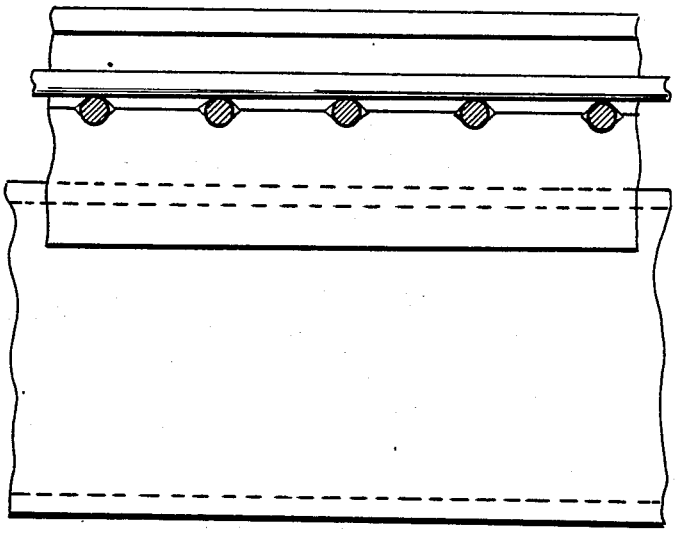
Figure 7:
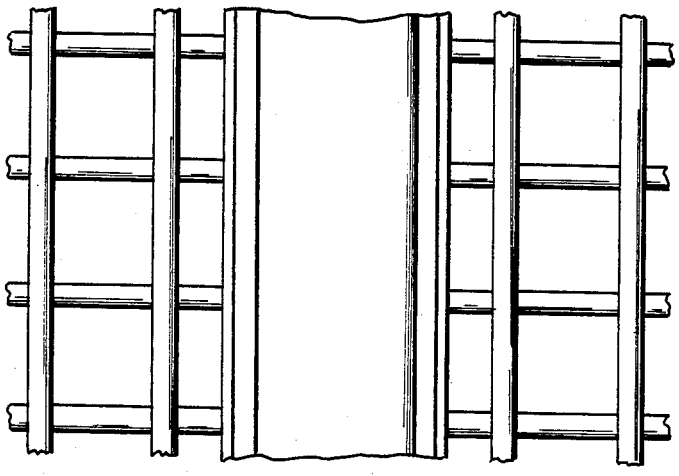
Figure 8:
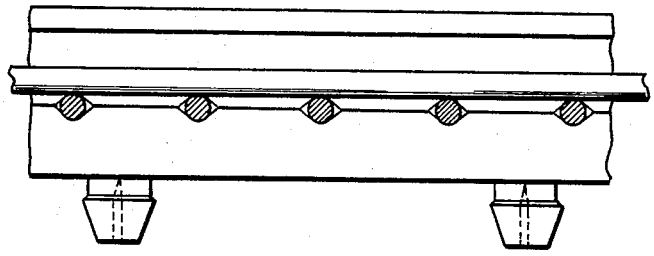

The exemplary embodiment according to FIG. 4 differs from the previous one in that the lower profile 2 is retained solely by studs 18 in apertures of the substructure, particularly in bores of a profile, not shown.

We claim:

1. A screening unit which comprises:

a load-bearing generally horizontally substructure formed with upwardly open U-shaped profiles having first and second metal rails with top edges bent inwards to define a gap between them;

a pair of screen elements supported on said substructure and having outer peripheries;

a profiled lower elongated one-piece plastic screen-element retainer directly affixed to said substructure, extending longitudinally along a respective one of said upwardly open U-shaped profiles, having a pair of upwardly directed and longitudinally extending opposite upper edges, formed on its underside with a pair of downwardly open channels each receiving the top edge of a respective one of said rails, and provided between said channels with a downwardly projecting member engaged in said gap, said upwardly directed upper edges being provided with formations upwardly engaging said peripheries of said screen elements;

a profiled upper elongated one-piece plastic screen-element retainer detachably affixed directly to said lower retainer and having above the upper edges of said lower retainer downwardly directed opposite longitudinally extending edges; and means including formations on said edges of said upper retainer engaging downwardly with said peripheries for clamping said pair of screen elements each between a respective edge of said lower retainer and the respective edge of said upper retainer, one of said retainers being formed with at least one recess opening toward the other retainer, said other retainer being formed with at least one projection engaging releasably into said recess and molded integrally with said other retainer, said projection being a feather-shaped bar provided with substantially parallel lateral faces having a sawtooth profile engaging in complementary sawtooth profiles on flanks of said recess.

2. The screening unit as defined in claim 1 wherein said feature-shaped bar is provided in said upper retainer and said recess is provided in said lower retainer.

3. The screening unit as defined in claim 1 wherein the said tooth profiles of said feather-shaped bar and said flanks are oriented so that a greater force is required to separate said retainers than to urge them together.

4. The screening unit as defined in claim 3 wherein a steeper side of each sawtooth faces the top of said recess.

5. The screening unit as defined in claim 1 wherein the sawteeth extend over the full length of each projection and over the full length of the corresponding recess.

6. The screening unit as defined in claim 1 wherein said screen elements are metal mesh or grills.

7. The screening unit as defined in claim 1 wherein said screen elements are metal-reinforced plastic.

8. The screening unit as defined in claim 1 wherein said screen elements each have a body portion of relatively greater thiskness and an edge strip of relatively smaller thickness forming the respective peripheries, each edge strip being engaged between the respective formations of said upper and lower retainers.

9. The screening unit as defined in claim 8 wherein said edge strips are provided with ribs extending transversely of the respective strips on at least one side thereof.

10. The screening unit as defined in claim 1 wherein said formations on said edges of said retainers engageable with said screen elements are elevations receiving the peripheries of said screen elements.

11. A screening unit which comprises:

a load-bearing generally horizontal substructure formed with upwardly open U-shaped profiles having first and second metal rails with top edges bent inwards to define a gap between them;

a pair of screen elements supported on said substructure and having outer peripheries;

a profiled lower elongated one-piece plastic screen-element retainer directly affixed to said substructure, extending longitudinally along a respective one of said upwardly open U-shaped profiles, having a pair of upwardly directed and longitudinally extending opposite upper edges, formed on its underside with a pair of downwardly open channels each receiving the top edge of a respective one of said rails, and provided between said channels with a downwardly projecting member engaged in said gap, said upwardly directed upper edges being provided with formations upwardly engaging said peripheries of said screen elements;

a profiled upper elongated one-piece plastic screen-element retainer detachably affixed directly to said lower retainer and having above the upper edges of said lower retainer downwardly directed opposite longitudinally extending edges; and means including formations on said edges of said upper retainer engaging downwardly with said peripheries for clamping said pair of screen elements each between a respective edge of said lower retainer and the respective edge of said upper retainer, one of said retainers being formed with at least one recess opening toward the other retainer, said other retainer being interconnected by fastening means constructed and arranged to enable said retainers to assume at least two high-strength positions in which different thicknesses of said screen elements can be clamped between them.

* * * * *